US006402433B1

(12) United States Patent
Gillespie

(10) Patent No.: US 6,402,433 B1
(45) Date of Patent: Jun. 11, 2002

(54) TENSIONABLE MINE ROOF BOLT

(76) Inventor: H. Doug Gillespie, 11637 El Camino del Diablo, Yuma, AZ (US) 85367

( * ) Notice: Subject to any disclaimer, the term of this patent is extended or adjusted under 35 U.S.C. 154(b) by 0 days.

(21) Appl. No.: 09/624,952

(22) Filed: Jul. 25, 2000

(51) Int. Cl.[7] ..... E21D 20/00; E21D 21/02

(52) U.S. Cl. ..... 405/259.1; 405/259.6; 405/302.2

(58) Field of Search ..... 405/259.1, 259.6, 405/302.2, 259.3, 259.4

(56) References Cited

U.S. PATENT DOCUMENTS 5,531,545 A * 7/1996 Seegmiller et al. ..... 405/259.4
5,586,839 A * 12/1996 Gillespie ..... 405/259.1
5,624,212 A * 4/1997 Gillespie ..... 405/302.2
6,074,134 A * 6/2000 Stankus et al. ..... 405/259

* cited by examiner

*Primary Examiner*—David Bagnell
*Assistant Examiner*—Daniel P Stephenson
(74) *Attorney, Agent, or Firm*—Michael D. McCully

(57) ABSTRACT

A tensionable mine roof bolt is constructed of multi-strand steel cable. The head end of the bolt is formed of an outer sleeve that is externally threaded at least part of the way from the end, in order to accept a conventional tension nut. The cable bolt shaft includes an enlarged section that is slightly larger than the diameter of the axial bore through the bolt head sleeve so that the cable enlarged section interferes with the bolt head sleeve as the enlarged section is pressed into the outer sleeve to form the cable bolt. The cable enlarged section is formed by the addition of a spacer sleeve around the cable center strand (king wire) and between the cable center strand and peripheral strands, or by the addition of a cable sleeve around the cable at the appropriate location. Either design will result in the cable enlarged section's having a greater outside diameter than the bolt head sleeve internal diameter bore, to result in the interference as the cable enlarged section is pressed into the bolt head sleeve. The outer sleeve is swaged down upon the cable to define a cable bolt tension head. The tension head includes radially aligned wings formed thereon. The external diameter of these wings is slightly greater than the internal diameter of the mine roof bore hole, so that the tension head must be driven into the rock formation above the mine tunnel roof. The radially aligned wings function to prevent the bolt tension head from rotating within the bore hole as the cable bolt is post-installation tensioned and/or re-tensioned, in order to prevent twisting and torquing of the cable section of the bolt within the bore hole between the resined-in bolt anchor and tension head.

32 Claims, 6 Drawing Sheets

TENSIONABLE MINE ROOF BOLT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The present invention relates to mine roof bolts, and more particularly relates to tensionable mine roof bolts constructed of multi-strand steel cable.

2. Description of Related Art Including Information Disclosed Under 37 C.F.R. §1.97 and 37 C.F.R. §1.98

In the art of mine tunnel roof support, there are two major categories of bolting systems wherein mine roof bolts are anchored in bore holes drilled in the mine tunnel roof, the bolts' purpose being to reinforce and stabilize the unsupported rock formation above the mine tunnel. These two categories of mine roof bolting systems are: (1) tension-type systems, and (2) passive-type systems. In each system, it is common practice to, first, drill a hole through the mine tunnel ceiling into the rock formation above to a depth appropriate for the type of rock formation to be supported. A mine roof bolt and roof plate are then anchored in the bore hole to support the mine roof and maintain the rock formation in place.

In a common tension-type mine roof bolt system, an expansion shell type anchor is installed on the threaded end of the bolt. The bolt and expansion shell anchor are inserted up into the bore hole until the roof plate is against the mine roof. The bolt is then rotated to thread a tapered plug section of the expansion shell down toward the bolt head, in order to expand the jaws of the expansion shell against the interior wall of the bore hole to thereby hold the mine roof bolt in place within the bore hole, the mine roof bolt functioning to support and stabilize the rock formation above the mine tunnel.

In passive-type mine roof bolt systems, the passive-type bolt is not attached to an expansion shell or similar anchor at the free (upper) end of the bolt, but rather is retained in place within the rock formation by a rapid-curing resin adhesive material that is mixed in the bore hole as the bolt is rotated and positioned within the bore hole. In theory, the resin adhesive bonds the bolt to the rock formation along the total length of the bolt within the bore hole in the rock formation. It is also common practice to use resin adhesive with a tension-type mine roof bolt to retain the bolt within the mine roof bore hole, at least along the upper portion of the bolt. Again, when the rock formation shifts, certain types of tension system bolts can be retightened by rotating the bolt or nut.

In passive-type and some tension-type mine roof bolting systems, one or more resin cartridges are inserted into the bore hole prior to (ahead of) the mine roof bolt. Forcing the mine roof bolt into the bore hole while simultaneously rotating the bolt ruptures the resin cartridge(s) and mixes the resin components within the annulus between the bolt shaft and bore hole wall. Ideally, the resin adhesive mixture totally fills the annulus between the bolt shaft and bore hole wall at least along the upper portion of tension-type bolting systems, and along the total length of the bolt shaft and bore hole wall in passive-type systems. The resin mixture is forced into cracks and crevices in the bore hole wall and into the surrounding rock formation to adhere the bolt to the rock formation.

When extremely long mine roof bolts are necessary, it is common practice to attach two or more bolt shaft sections together by couplers to result in a "roof bolt" of sufficient length appropriate for the particular type of rock formation. These couplers between bolt sections, being of a larger diameter than the bolt shafts, prevent the mixed resin adhesive from flowing downwardly (resin return) within the bore hole annulus from the first (upper) bolt section to the lower section(s). Therefore, the effective anchoring of the bolt to the bore hole wall within the rock formation is, essentially, only along the length of the first (upper) bolt section wherein the resin adhesive totally fills the annulus between the bolt section and the bore hole wall.

To alleviate this problem, it has been common practice simply to drill a larger bore hole in the rock formation that will enable the resin adhesive to flow around the coupler(s) as the bolt is being inserted into and rotated within the bore hole to mix the resin. Although this does effect the desired result (resin return around the coupler(s) within the annulus between the bolt shaft and bore hole wall), it creates another problem that, depending on the type of rock formation, may be more dangerous than the problem that is corrected by a larger bore hole. Specifically, bonding of the resin adhesive material to hold the mine roof bolt in place within the bore hole is considerably weakened by virtue of the increased distance between the bolt shaft and bore hole wall, and the sheer volume of resin adhesive material necessary to totally fill the annulus. Additionally, by virtue of their specific makeups, mine roof rock formations that actually require long (fifteen feet or longer) mine roof bolts are more susceptible to movement and shifting within the rock formation, than are more solid rock formations that require only shorter mine roof bolts.

Another common problem with using mine roof bolt sections coupled together in such rock formations that require longer (coupled) mine roof bolts, this shifting of the rock formation (shear) causes the bolt couplers to fracture. When this happens, of course, the effective holding length of the mine roof bolt is instantly decreased. In many instances, there is no or very little resin adhesive material around the broken bolt shaft to help stabilize the rock formation. Therefore, in almost all instances, this shortened mine roof bolt is ineffective to safely prevent the mine roof rock formation from further shifting and potential collapse.

In response to these problems, so-called "cable bolts" have been devised for both tension-type systems and passive-type systems. A common design for a tension-type (tensionable) mine roof bolt has a bolt "head" formed of a steel rod having an axial bore in one end and an externally threaded shaft at the other end. This "head" is swaged down upon the cable to define a rigid threaded end (tension head) of the mine roof bolt for receiving a tensioning nut. The threaded section of the bolt head permits tensioning of the bolt within the rock formation above the mine tunnel after the resin mixture has set, and also permits subsequent re-tensioning of the mine roof bolt when the bolt loosens as a result of shifts in the rock formation.

In theory, the tensionable cable bolt alleviates the problems inherent in using solid mine roof bolt sections in a shifting rock formation above the mine tunnel. In practice, however, the above-described tensionable cable bolt has introduced a different problem. Specifically, because the cable is not solid, it tends to twist or torque as it is being initially tensioned upon installation and solidification of the resin material, and also as it is periodically re-tensioned when necessary. This twisting or torquing of the cable has two effects, depending on whether the tightening torque applied to the nut is in the same direction as the cable twist or in the opposite direction of the cable twist. If the nut-tightening torque is in the opposite direction of the cable twist, of course, the cable will unwind and separate. If the nut-tightening torque is in the same direction as the twist of the cable, the cable will torque and twist within the hole, and will actually draw up (shorten) in length between the anchor and the tension head and nut, due to the spiral orientation of the twisted cable. The effective "shortening" of the free length of cable as it is being tensioned or re-tensioned, therefore, causes the cable to become taut prematurely, due to its artificially shortened length. Therefore, when the tensioning torque applied to the nut is released, the twisted cable is permitted to relax and untwist, thereby returning its effective length to the original pre-tensioned length. The effect of this is that the "tensioning" is lost, inasmuch as, due to the torquing and twisting of the cable within the bore hole, the "tensioning" turns out to be, in fact, false tensioning.

In addition, tensioning or re-tensioning tensionable cable bolts having the nut-tightening torque in the same direction as the cable twist also generates a "reverse torque" or opposing torque stored as potential energy within the twisted and torqued span of cable. As the rock formation shifts, the bolt tends to untorque or untwist within the bore hole, and therefore increase its effective length from the anchor to the tensioning nut. Of course, this increase in effective length of the bolt relaxes tension in the "false" tensioned bolt to zero, rendering the bolt ineffective to maintain the rock formation above the mine tunnel in the compression necessary to maintain the integrity of the rock formation.

OBJECTS OF THE INVENTION

It is therefore an object of the present invention to provide a tensionable mine roof cable bolt that does not twist within the mine roof bore hole as the bolt is being tensioned or re-tensioned.

It is another object of the present invention to provide a tensionable mine roof cable bolt that does not change in length as it is being tensioned or re-tensioned within the mine roof bore hole.

It is a further object of the present invention to provide a tensionable mine roof cable bolt that does not store potential energy in the form of coil spring torque that can be released to loosen the bolt within the bore hole, when the rock formation above the mine tunnel roof shifts.

BRIEF SUMMARY OF THE INVENTION

The tensionable mine roof bolt of the present invention is constructed of a length of pre-tensioned, multi-strand steel cable, commonly formed of six individual pre-tensioned steel strands spirally wrapped around a seventh steel strand. The head end of the bolt is formed of an outer sleeve that is externally threaded at least part of the way from the end, in order to accept a conventional tension nut. The cable bolt shaft includes an enlarged section that is slightly larger than the internal diameter of the bolt head outer sleeve so that the cable enlarged section slightly interferes with the bolt head outer sleeve as the enlarged section is pressed into the outer sleeve to form the cable bolt. The cable enlarged section is formed by the addition of a spacer sleeve around the cable center strand (king wire) and between the cable center strand and peripheral strands, or by the addition of a cable sleeve around the cable at the appropriate location. Either design will result in the cable enlarged section's having a slightly greater outside diameter than the bolt head outer sleeve internal diameter bore, to result in the interference as the cable enlarged section is pressed into the bolt head outer sleeve.

In a preferred embodiment, the steel outer sleeve is swaged onto the cable to define a rigid threaded tension head for receiving the tension nut in a manner to result in the forming of a plurality of aligned wings formed on the tension head. The maximum external diameter of these wings is slightly greater than the internal diameter of the mine roof bore hole, so that the cable bolt tension head must be driven into the rock formation at the mine tunnel roof. The aligned wings function to prevent the bolt tension head from rotating within the bore hole in order to prevent twisting and torquing of the cable section of the bolt within the bore hole between the resined-in bolt anchor and tension head. Because the bolt tension head does not torque or twist relative to the anchor, the above-listed problems inherent in present-day tensionable cable bolts are eliminated.

DESCRIPTION OF THE PREFERRED EMBODIMENT

Figure 1:
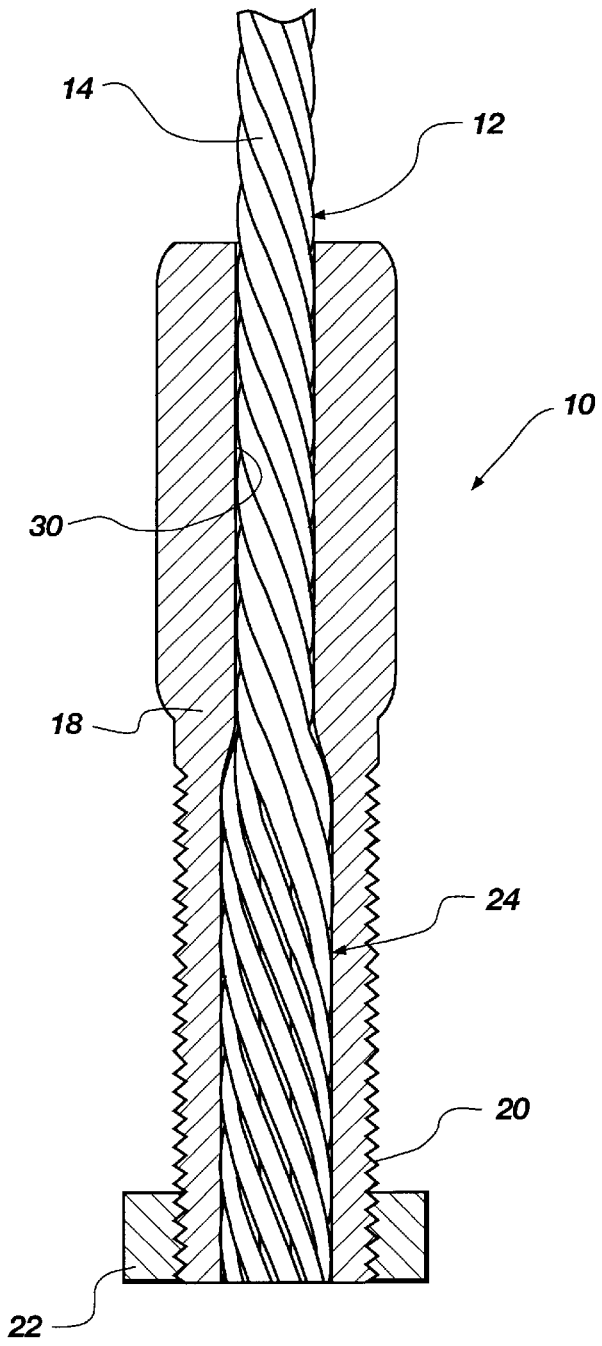
FIG. 1 is a partial sectional view of the tensionable cable bolt of the present invention, illustrating the multi-strand cable, enlarged cable section, and outer sleeve defining the bolt head.

Referring now to the drawings and initially to FIG. 1, the tensionable mine roof cable bolt of the prevent invention is shown, generally illustrated by the numeral 10. The tensionable cable bolt comprises a shaft 12, comprising a length of steel stranded cable, which in the embodiment shown, is made up of six peripheral steel strands 14 spirally wrapped around a center steel strand 16 (More clearly shown in FIG. 2.).

In a first embodiment of the tensionable cable bolt of the present invention, the bolt head is formed of an outer sleeve 18 having the cable shaft 12 pressed therein. This outer sleeve 18 may be of any desired length suitable for providing the desired amount of bolt re-tensioning as the rock formation above the mine tunnel roof (not shown) shifts. Typically, the length of the outer sleeve 18 can be anywhere from one foot to four feet or longer. Also typically, the outer diameter of the outer sleeve 18 is generally slightly less than the diameter of the mine tunnel roof bore hole.

The outer sleeve 18 includes a set of external threads 20 at the lower end thereof for receiving a threaded nut 22 thereon. In this embodiment, therefore, the tensionable cable bolt of the present invention is post-installation tensionable, by virtue of the threaded nut and external thread arrangement.

Figure 2:
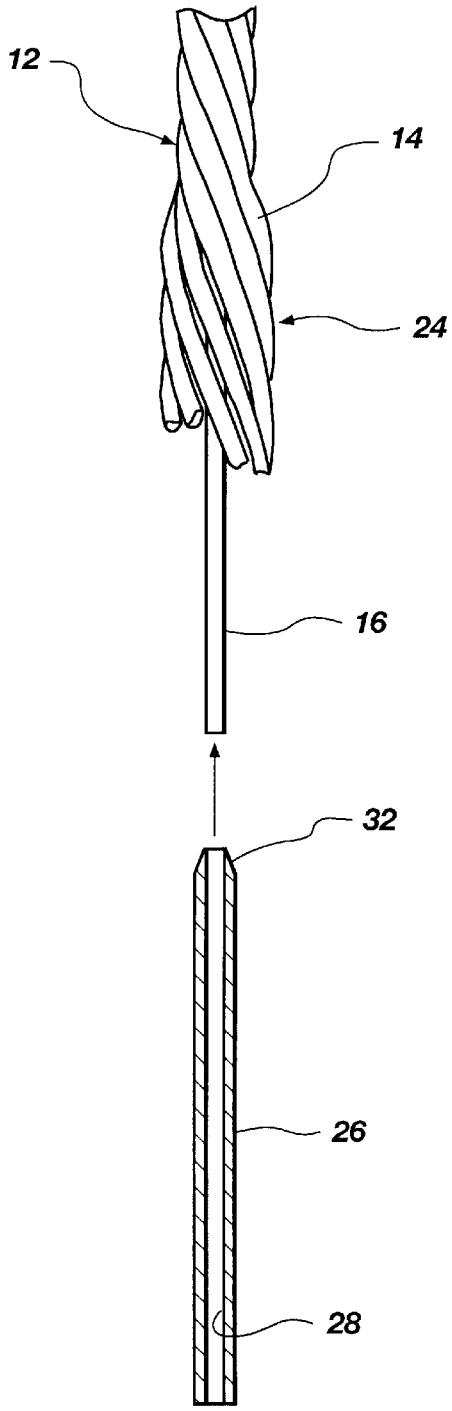
FIG. 2 is a sectional view of the center cable strand sleeve showing the tapered end thereof, and the manner in which the sleeve fits on the center cable strand and between the center strand and the spirally wound peripheral cable strands.

The cable shaft 12 is provided with an enlarged section, generally illustrated at 24. This cable enlarged section 24 may be better understood with reference to FIG. 2, which illustrates the structure for creating the enlarged section. In FIG. 2, the cable peripheral strands 14 are unwound and separated slightly at one end of the cable shaft 12, and a center wire sleeve 26 is slid directly onto the cable center strand 16, sometimes referred to as the king wire. The center wire sleeve 26 is a metal sleeve, formed of metal slightly softer than the steel strands that comprise the bolt shaft cable. The center wire sleeve 26 has an internal bore 28 that is sized to approximate the outside diameter of the cable center strand 16. In addition, the center wire sleeve 26 may include a longitudinal slit therein (not shown) to permit the sleeve to (1) expand slightly to facilitate installation onto the cable center strand, and (2) compress and deform slightly as the cable enlarged section 24 is pressed into the outer sleeve 18 to form the tensionable cable bolt.

As shown in FIG. 2, the center wire sleeve 26 is slipped directly onto the cable center strand 16 (the cable peripheral strands having been unwound slightly and separated from the center strand), and the cable peripheral strands rewound directly over the center wire sleeve in order to define the cable enlarged section adjacent the end of the cable. The resulting outside diameter of the cable enlarged section 24 is slightly larger than the diameter of the original internal bore 30 through the outer sleeve 18. This original outer sleeve internal bore 30 is generally of a diameter equal to or slightly greater than the cable diameter, so that the bolt cable can relatively easily be pulled through the outer sleeve, but that the cable enlarged section 24 interferes with the outer sleeve because its diameter is greater than the outer sleeve internal bore. This interference between the cable enlarged section 24 and the outer sleeve internal bore causes the outer sleeve internal bore and the center wire sleeve 26 to deform slightly as the cable enlarged section is pressed into the outer sleeve, and, of course, provides the resistance to tension load applied to the cable bolt.

The preferred embodiment of the center wire sleeve 26 includes a tapered conical surface 32 at one end thereof for providing a smooth transition of the outside diameter of the cable shaft 12 to the cable enlarged section 24. Those skilled in the art will readily appreciate that this transition from the cable diameter to the outer diameter of the cable enlarged section provided by the center wire sleeve tapered conical surface 32 eliminates the possibility of forming nicks in the peripheral cable strands 14 otherwise caused by a non-tapered surface at the (upper) end of the center wire sleeve, which peripheral strand nicks would tend to weaken the peripheral cable strands and initiate fractures in the peripheral cable strands as increased tension load is put on the tensionable cable bolt.

Figure 3:
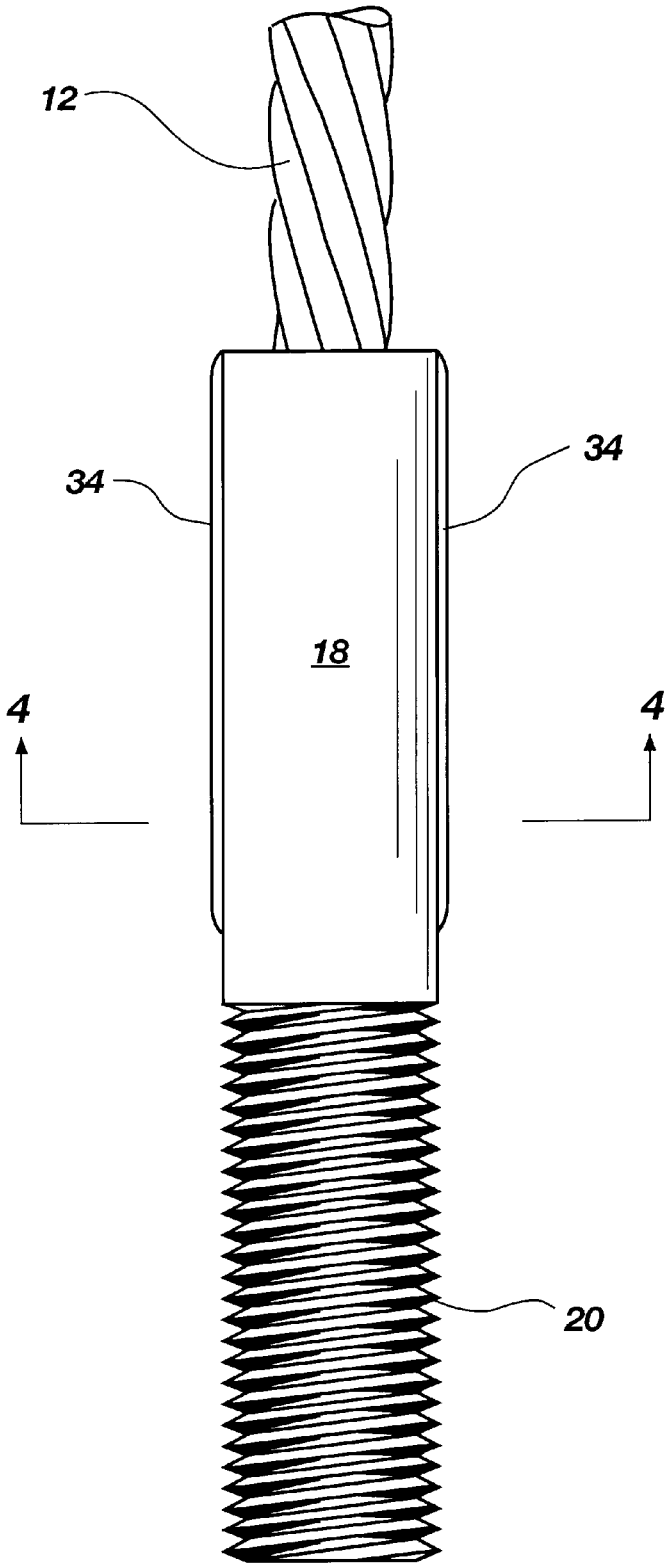
FIG. 3 is a view of the tension head of the mine roof bolt illustrating the wings for anchoring the tension head in the rock formation adjacent the mine tunnel roof.
Figure 4:
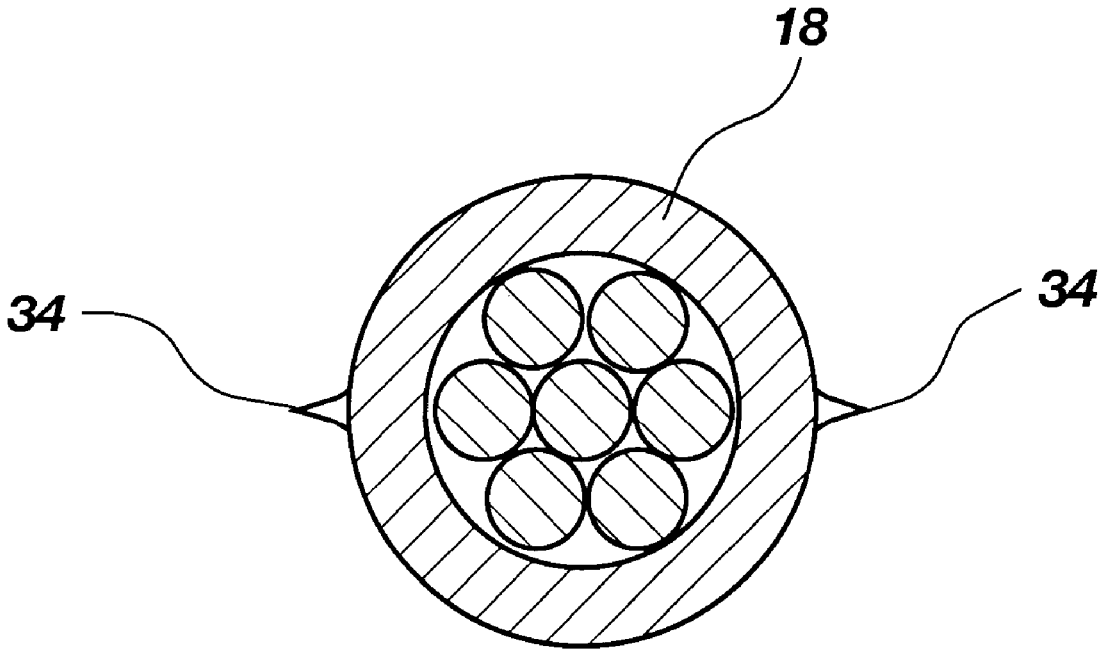
FIG. 4 is a sectional view of the tensionable mine roof cable bolt, taken in the direction of arrows 4—4 in FIG. 3.

In one embodiment, the steel outer sleeve that becomes the tension head 18 is swaged onto the cable by a piston-ram swaging device (not shown). The swaging device has a stationary semi-cylindrical die, and an opposing semi-cylindrical die mounted on the ram piston for swaging the outer sleeve onto the cable in diametrical fashion. As a practical matter, the two semi-cylindrical dies are not 100% completely semi-cylindrical. The result is that, when the steel outer sleeve is swaged onto the cable, swaging causes some of the outer sleeve material to be forced radially outwardly between the dies, forming two diametrically aligned radial wings 34 that function to prevent the tensioning head from rotating within the mine roof bore hole as the bolt is post-installation tensioned and re-tensioned as required. The tension head and wings are best shown in FIGS. 3 and 4.

For other cable bolt embodiments, the swaging device may have a plurality of dies mounted on respective ram pistons for swaging the outer sleeve onto the cable in a manner to provide a plurality of linear aligned radial wings along the essentially cylindrical outer surface of the outer sleeve. For example, three ram piston devices may be spaced radially at 120° about the longitudinal axis of the outer sleeve and cable to result in three equally-spaced wings on the bolt tension head. Likewise, four ram piston devices may be spaced radially at 90° about the longitudinal axis of the outer sleeve and cable to result in four equally-spaced wings on the bolt tension head. As in the dies used in production of the preferred embodiment bolt tension head, the plurality of 120° or 90° dies are not 100% completely 120° or 90° arcuate, respectively, so that swaging causes some of the outer sleeve material to be forced radially outwardly between the dies, forming the appropriate number of aligned radial wings 34 that function to prevent the tensioning head from rotating within the mine roof bore hole as the bolt is post-installation tensioned and re-tensioned as required.

As shown, the outer sleeve that becomes the tension head 18 is swaged onto the cable 12 in the area above (ahead of) the cable enlarged section 24 in a manner to prevent the cable enlarged section from pulling through the tension head. In addition, the length of the cable center wire sleeve 26 and overall diameter of the cable enlarged section 24 are determined so that the cable will be held within the tension head well beyond the tension failure maximum loading of the cable.

Figure 5:
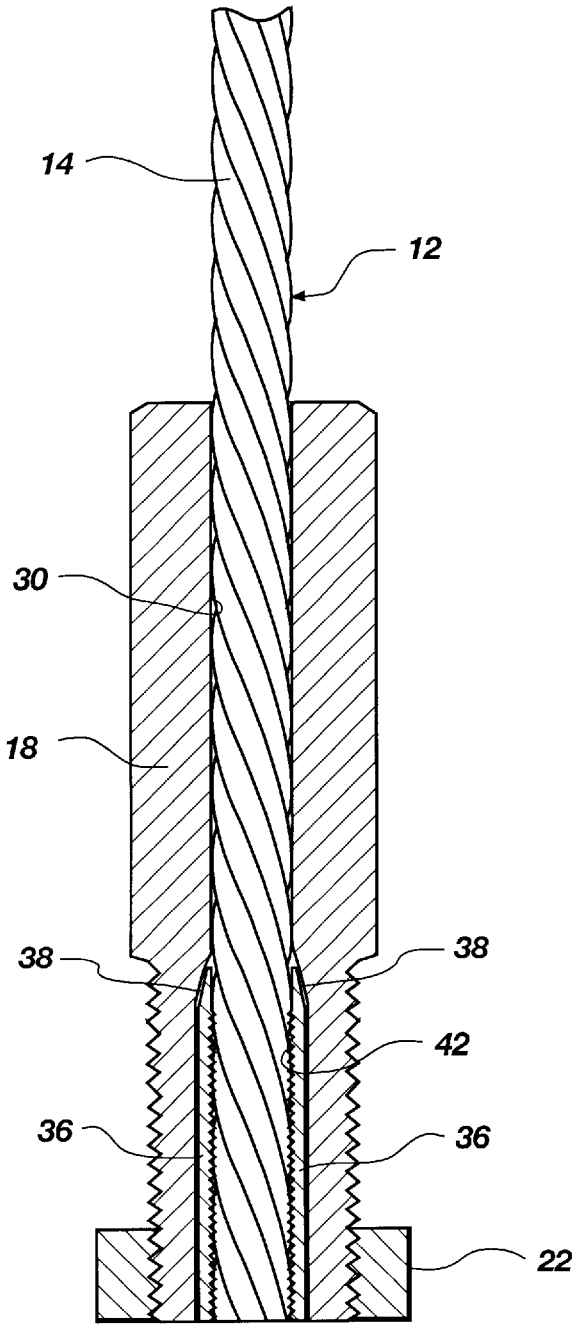
FIG. 5 is a view similar to FIG. 1 of an alternative embodiment tensionable cable bolt, illustrating the cable sleeve.

The pre-swaging diameter of the steel outer sleeve that becomes the tension head is sized to result in the formed tension head wings 34 being of a diametric distance that is greater than the inside diameter of the mine roof bore hole. In addition, and as best shown in FIGS. 1, 3, and 5, the formed wings 34 have curved outer surfaces from top to bottom, and have inherently sharp outside cutting edges (best shown in FIG. 4) for cutting into the rock formation surrounding the mine roof bore hole. It is therefore intended that the cable bolt tension head be driven into the rock formation bore holes so that the tension head wings 34 cut into the rock formation to prevent the tension head from rotating within the bore hole. Understandably then, any rotation of the tensionable mine roof bolt within the bore hole in order to thoroughly mix the resin material at the top of the bore hole must be ceased at the time that the mine roof bolt tension head approaches the mine tunnel roof as it is being inserted into the bore hole.

FIG. 5 is a view similar to FIG. 1, illustrating an alternative embodiment of the tensionable cable bolt of the present invention. The cable bolt of the embodiment of FIG. 5 does not include the cable enlarged section formed by the center wire sleeve positioned around the cable center strand and under the cable peripheral strands. Rather, the enlarged section of the cable is formed by the addition of a cable sleeve 36 positioned directly around the cable shaft 12 at the threaded (lower) end of the outer sleeve 18. In this embodiment, the cable sleeve 36 may be formed in a single cylindrical piece, two essentially identical semi-cylindrical sleeve-like pieces, or three or more essentially identical arcuate sections. With a single cylindrical piece cable sleeve 36, the cable sleeve includes a longitudinal slit (not shown) therein to enable the sleeve to (1) expand slightly to facilitate installation onto the cable, and (2) compress slightly as the cable and sleeve are pressed into the outer sleeve 18 to form the tensionable cable bolt.

FIG. 5 also illustrates that the cable sleeve 36 includes an external annular taper 38 on the leading end thereof. This annular taper, of course, facilitates initial insertion of the cable sleeve 36 (positioned around the cable shaft 12) into the end of the outer sleeve 18 to form the tensionable cable bolt.

Figure 6:
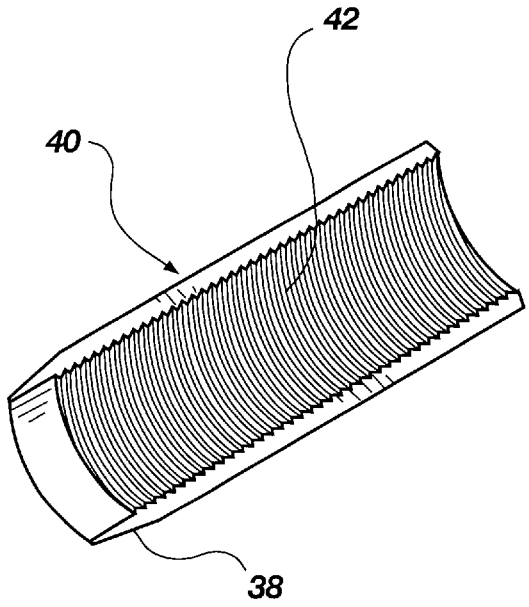
FIG. 6 is a perspective view of a semi-cylindrical cable sleeve section.

FIG. 6 is a perspective view of a semi-cylindrical section 40 of a two-piece cable sleeve similar to that shown in FIG. 5. The perspective view of FIG. 6 more clearly shows the parallel annular serrations 42 within the cable sleeve, and also illustrates the external annular taper 38 on one end of the cable sleeve, as previously described.

Figure 7:
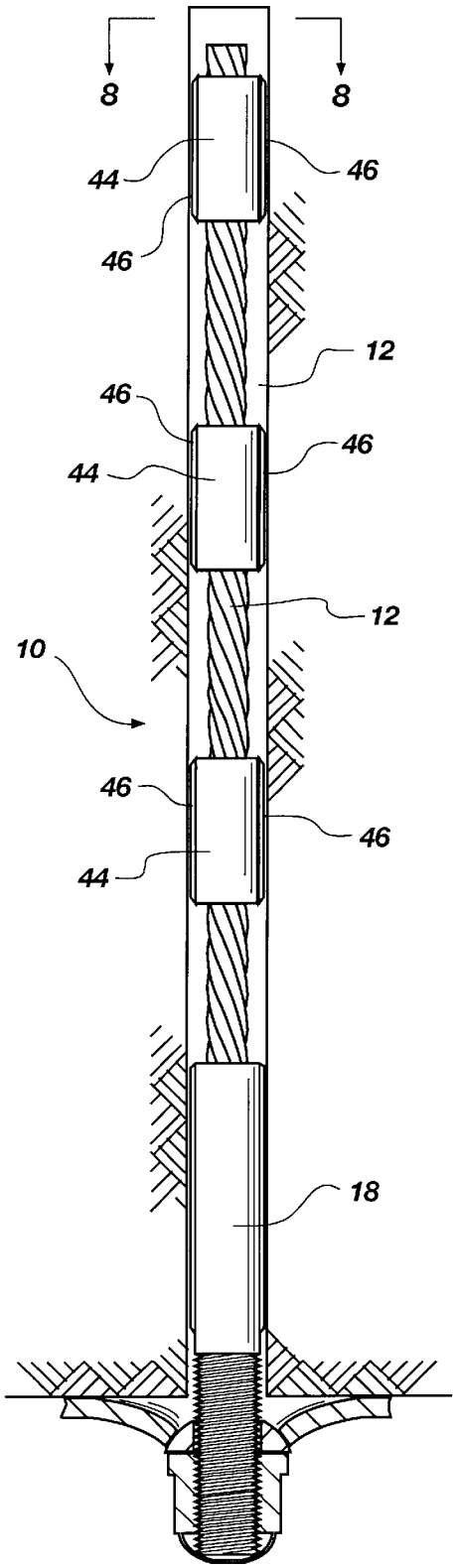
FIG. 7 is a side elevational view of the tensionable mine roof bolt of the present invention, the tension head shown partially in vertical section, illustrating typical placement of the anchor collars.

As shown in FIG. 7, the cable bolt includes a plurality of anchor collars 44 attached to the cable at various points. These anchor collars 44 take the form of steel sleeves or cylinders that are swaged down upon the cable 12 with sufficient force to deform the sleeve material into the interstices between the individual peripheral steel strands of the multi-strand cable in order to more securely attach the anchor collar to the cable against axial slippage.

Figure 8:
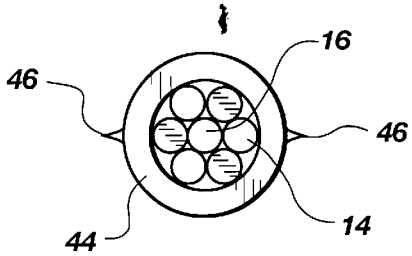
FIG. 8 is an end view of the tensionable cable bolt illustrated in FIG. 7, looking in the direction of arrows 8—8 in FIG. 7.

As in the steel outer sleeve that becomes the tension head, the steel cylinders that become the anchor collars 44 are swaged onto the cable by a piston-ram swaging device (not shown). The swaging device has a stationary semi-cylindrical die, and an opposing semi-cylindrical die mounted on the ram piston for swaging the cylinder on the cable in diametrical fashion. Similarly, the two semi-cylindrical dies are not 100% completely semi-cylindrical, so that when the steel cylinder is swaged onto the cable, swaging causes some of the cylinder material to be forced radially outwardly between the dies, forming two diametrically aligned wings 46 that function as centering devices to center the anchor collars and cable bolt within the bore hole. The anchor collar and wings are best shown in FIGS. 7 and 8.

The pre-swaging diameter of the steel cylinder that becomes an anchor collar 44 is sized to result in the formed anchor collar wings 46 being of a diametric distance that corresponds to the inside diameter of the mine roof bore hole. In addition, and as best shown in FIG. 7, the formed wings 46 have curved outer surfaces from top to bottom, and have inherently sharp outside cutting edges (best shown in FIG. 8) for cutting into and shredding the plastic casing of the resin grout material capsule (not shown) as the end of the cable bolt is inserted up into the mine roof bore hole against the resin material capsule.

In one embodiment, the cable bolt includes a plurality of anchor collars 44 equally spaced along the cable shaft. In accordance with a primary aspect of the invention, each anchor collar 44 is rotated approximately 90° from each adjacent anchor collar. This orientation serves the multiple purposes of (1) optimizing the function of the anchoring collars to center the cable shaft within the bore hole, (2) improved cutting and shredding of the resin material plastic capsule as the cable shaft is inserted up into the mine tunnel roof bore hole against the resin capsule, and (3) optimizing the mixing of the resin material as it is forced into the annulus between the mine tunnel roof bore hole and the series of anchor collars and into the annulus between the mine tunnel roof bore hole and the sections of cable between adjacent anchor collars. The inventor has determined that the combination of the plurality of anchor collars 44 at a relative close spacing therebetween and the alternating orientation of the anchor collar wings 46 mixes the resin material sufficiently thoroughly that rotating or spinning of the cable bolt within the bore hole is not necessary. Therefore, the tensionable cable bolt of the present invention can be anchored in the rock formation above the mine tunnel using the much stronger resin material, as opposed to previous mine roof bolts that require spinning within the bore hole to mix the resin material, and as opposed to other previous cable bolt systems that must utilize weaker, no-mix cement.

Figure 9:
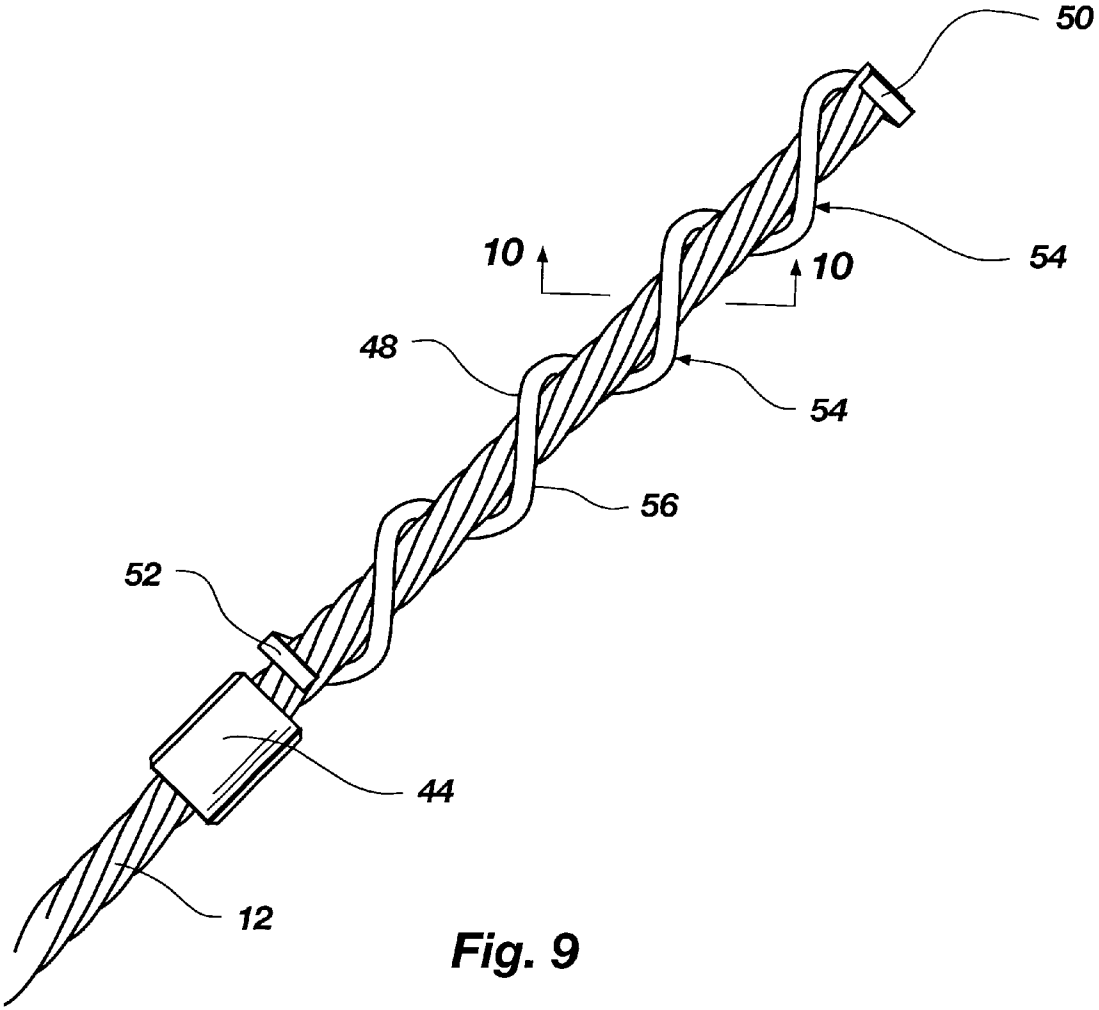
FIG. 9 is a side elevational view of the end of an alternative embodiment of the anchoring mechanism for the tensionable cable bolt.

FIG. 9 is a side elevation view of the end of an alternative embodiment of the tensionable cable bolt. This alternative embodiment replaces the end anchor collar with a steel wire coil 48 spirally wrapped around the end of the cable shaft. The remote end 50 of the steel wire coil is swaged onto the end of the cable. The opposite end 52 of the steel wire coil may or may not be swaged onto the cable.

Figure 10:
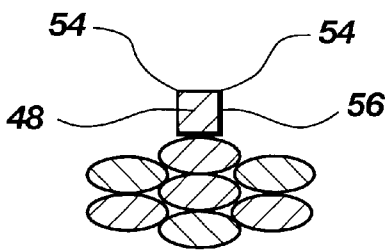
FIG. 10 is a sectional view through the spirally wrapped resin capsule shredder and resin mixer of the alternative embodiment of FIG. 9, taken in the direction of arrows 10—10 in FIG. 9.

As best shown in FIG. 10, the steel wire coil 48 is not a "wire" in the general sense of the term. Rather, the steel wire coil 48 takes the form of a steel outer sleeve having a square cross-section that is spirally wrapped around the end of the cable. The inventor has determined that the square cross-section of the spirally wrapped steel wire coil is a considerable improvement over previous spirally wrapped wires. Specifically, the steel wire coil 48, having a square cross-section, by definition, includes two sharp-cornered spiral leading edges 54 that function to: (1) shred the resin material capsule, emptying the contents therefrom, and (2) more effectively churn and mix the resin catalyst with the active resin agent, than can be done with spirally wrapped wires having round cross-sections. The reason for this is that, as a spirally wrapped wire having a round cross-section is caused to rotate through the chemical resin material, the rounded front surface of the circular wire tends to only spread the existing resin material components in a manner similar to that in which the leading edge of an airfoil spreads the fluid medium. By contrast, the sharp edges of the square cross-section wire do not simply spread the chemical resin material as the steel wire coil pushes through. Rather, the angled spiral top surface 56 of the steel wire coil 48 causes the chemical resin material to slide downwardly and around the sharp edges 54, thereby thoroughly churning and mixing the catalyst with the resin active agent as the shaft of the cable is inserted into the borehole. The inventor has determined that four "flights" or revolutions of the square steel wire coil 48 around the cable shaft 12 for a length of approximately ten inches, are sufficient to thoroughly rotate the catalyst and churn it into the resin active agent in order to ensure a thorough and complete mix of the resin material, without the necessity of rotating the cable bolt.

The inventor has also determined that a 5/16 diameter square steel outer sleeve spirally wrapped around the cable shaft is an optimum size for thoroughly mixing the resin material within the borehole annulus around the cable shaft. This 5/16 diameter square outer sleeve spirally wrapped around a 0.600 diameter cable shaft essentially totally fills a 1¼" diameter borehole, thereby also ensuring a thorough mix of the resin catalyst and active agent by forcing the resin catalyst to be churned into the resin active agent by the spirally wrapped steel wire coil.

Installation

The tensionable mine roof bolt of the prevent invention is installed in a manner similar to previous tensionable cable bolts. Specifically, the cable shaft is inserted into a mine roof bore hole following the insertion of one or more resin cartridges. A nut is installed on the threaded section of the tension head, and the nut is then positioned in the head of the boom of a mine tunnel roof drilling and roof bolt inserting machine. During the initial stages of forcing the tensionable cable bolt up into the mine roof bore hole, the tensionable cable bolt may or may not be rotated or spun to assist in mixing the resin material.

The tensionable cable bolt of the present invention is intended to fully mix the resin material within the mine roof bore hole without the necessity or rotating or spinning the cable bolt. Nonetheless, the installer may spin the bolt within the bore hole until the cable bolt tension head 18 approaches the surface of the mine tunnel roof, at which time rotation or spinning of the cable bolt must cease. As the cable bolt tension head approaches the mine tunnel roof surface, all rotation or spinning is stopped, and the cable bolt tension head is simply forced or driven up into the mine tunnel roof bore hole. Because of the fact that the outside diameter (exclusive of the wings) of the cable bolt tension head is essentially that of, or possibly slightly smaller than, the bore hole ID, the equally-spaced tension head radial wings cut into the sides of the bore hole adjacent the roof as the tensionable cable bolt is driven into the mine tunnel roof bore hole. Once the tensionable cable bolt is in position within the mine tunnel roof bore hole to permit the mixed resin material to set, it is not necessary to further maintain upward force on the bolt tension head (i.e., the tension nut) in order to retain the tensionable cable bolt within the bore hole for the resin material to "set". This is because of the fact that the tension head equally spaced radial wings have been driven or forced into the mine tunnel roof bore hole rock formation. Therefore, the installer is free to proceed to the next bore hole without waiting the customary 1–2 minutes for the resin material to set within the bore hole and around the cable bolt.

Once the resin is set, the tensionable cable bolt of the present invention is post-installation tensioned in the customary manner. The improvement, however, is that the cable bolt tension head does not rotate within the mine roof bore hole as the cable bolt is post-installation tensioned or subsequently re-tensioned because of loosening due to rock formation shifts above the mine tunnel. This "non-rotation" of the cable bolt tension head is effected by the equally-spaced tension head radial wings driven into the rock formation around the mine tunnel roof bore hole. Therefore, the bolt cable shaft is not twisted, untwisted, or torqued, resulting in affecting the effective length of the cable bolt, which would otherwise result in "false-tensioning" of the cable bolt and therefore premature loosening of the cable bolt within the mine roof bore hole.

From the foregoing it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

LIST OF REFERENCE NUMBERS

10 tensionable mine roof bolt
12 bolt shaft (cable)
14 peripheral cable strands
16 central cable strand
18 outer sleeve (tension head)
20 tension head external threads
22 tension head nut
24 cable enlarged section
26 cable center wire sleeve
28 cable center wire sleeve internal bore
30 tension head internal bore
32 center wire sleeve tapered conical surface
34 tension head wings
36 cable sleeve
38 cable sleeve external annular tapered surface
40 cable sleeve semi-cylindrical section
42 cable sleeve annular serrations
44 anchor collars
46 anchor collar wings
48 steel wire coil
50 coil remote end
52 coil opposite end
54 coil spiral leading edge
56 coil spiral angled top surface

What is claimed is:

1. A tensionable mine roof cable bolt for installation in a mine tunnel roof borehole, the cable bolt comprising:

a length of multi-strand cable defining a bolt shaft; and a tension head externally threaded along at least a first end thereof, and permanently attached to a first end of the cable at a second end of the tension head, the tension head including rotation-preventing means for preventing rotation of the tension head within the mine tunnel roof borehole.

2. A tensionable mine roof cable bolt as set forth in claim 1, wherein the tension head includes an axial bore hole therethrough, and wherein the second end of the tension head is swaged down upon the first end of the cable for a permanent attachment thereto.

3. A tensionable mine roof cable bolt as set forth in claim 2, wherein the rotation-preventing means comprises a radially outwardly projecting wing oriented axially relative to the tension head.

4. A tensionable mine roof cable bolt as set forth in claim 3, wherein the rotation-preventing means comprises two radially outwardly and diametrically opposed projecting wings oriented axially relative to the tension head.

5. A tensionable mine roof cable bolt as set forth in claim 4, wherein the tension head is essentially cylindrical and wherein the wings are oriented across the diameter of the tension head.

6. A tensionable mine roof cable bolt as set forth in claim 3, wherein the rotation-preventing means comprises a plurality of radially outwardly projecting wings oriented axially relative to the tension head.

7. A tensionable mine roof cable bolt as set forth in claim 1, further comprising slip prevention means for preventing the multi-strand cable from slipping within the bore hole.

8. A tensionable mine roof cable bolt as set forth in claim 7, wherein the slip prevention means comprises an anchor collar swaged onto the cable.

9. A tensionable mine roof cable bolt as set forth in claim 8, further comprising a plurality of anchor collars swaged onto the cable.

10. A tensionable mine roof cable bolt as set forth in claim 8, wherein the anchor collar includes outwardly projecting wings for centering the cable within the bore hole and for puncturing resin adhesive cartridges.

11. A tensionable mine roof cable bolt as set forth in claim 10, wherein the anchor collar is cylindrical, and wherein the wings are oriented across the diameter of the collar.

12. A tensionable mine roof cable bolt as set forth in claim 11, wherein the wings extend radially from the anchor collar.

13. A tensionable mine roof cable bolt as set forth in claim 1, further comprising mixing means formed on the cable shaft for shredding chemical resin capsules and mixing chemical resin within the bore hole.

14. A tensionable mine roof cable bolt as set forth in claim 13, wherein the mixing means comprises a outer sleeve spirally wrapped around the cable adjacent an end thereof.

15. A tensionable mine roof cable bolt as set forth in claim 14, wherein the outer sleeve has an approximate square cross-section.

16. A tensionable cable bolt comprising:

a length of multi-strand cable comprising a center wire and a plurality of peripheral wires spirally wrapped around the center wire;

a center wire sleeve positioned around the cable center wire and between the cable center wire and peripheral wires to define an enlarged cable section; and an outer sleeve having an inside diameter slightly less than the outside diameter of the enlarged cable section, the outer sleeve including rotation-preventing means for preventing rotation of the outer sleeve within the mine tunnel roof borehole;

whereby the outer sleeve is positioned over the cable, and the enlarged cable section is pressed into one end of the outer sleeve to result in the cable bolt.

17. A tensionable cable bolt as set forth in claim 16, wherein the outer sleeve has external screw threads on an end thereof, and the cable bolt includes a nut screwed onto the outer sleeve external threads defining a bolt head.

18. A tensionable cable bolt as set forth in claim 16, wherein the center wire sleeve includes an axially oriented slit to permit the sleeve to expand slightly to facilitate installation on the cable center wire.

19. A tensionable cable bolt as set forth in claim 16, wherein the center wire sleeve is tapered at one end thereof.

20. A tensionable cable bolt as set forth in claim 16, further comprising slip prevention means for preventing the cable from slipping relative to resin adhesive material within a bore hole.

21. A tensionable cable bolt as set forth in claim 20, wherein the slip prevention means comprises an anchor sleeve mounted on the cable.

22. A tensionable cable bolt as set forth in claim 21, wherein the anchor sleeve includes outwardly projecting wings for centering the cable within the bore hole and for puncturing resin adhesive cartridges.

23. A tensionable cable bolt comprising:

a length of multi-strand cable comprising a center wire and a plurality of peripheral wires spirally wrapped around the center wire;

a cable sleeve positioned around the cable; and an outer sleeve having an inside diameter slightly less than the outside diameter of the cable sleeve, the outer sleeve including rotation-preventing means for preventing rotation of the outer sleeve within the mine tunnel roof borehole;

whereby the outer sleeve is positioned over the cable, and the cable and cable sleeve are pressed into one end of the outer sleeve to result in the cable bolt.

24. A tensionable cable bolt as set forth in claim 23, wherein the outer sleeve has external screw threads on an end thereof, and the cable bolt includes a nut screwed onto the outer sleeve external threads defining a bolt head.

25. A tensionable cable bolt as set forth in claim 23, wherein the cable sleeve includes an axially oriented slit to permit the sleeve to expand slightly to facilitate installation on the cable.

26. A tensionable cable bolt as set forth in claim 23, wherein the cable sleeve is tapered at one end thereof to facilitate pressing the cable and cable sleeve into the outer sleeve.

27. A tensionable cable bolt as set forth in claim 26, wherein the cable sleeve comprises a plurality of partial sections, together defining the cable sleeve when positioned around the cable.

28. A tensionable cable bolt as set forth in claim 27, wherein the cable sleeve comprises two semi-cylindrical partial sections.

29. A tensionable cable bolt as set forth in claim 23, further comprising slip prevention means for preventing the cable from slipping relative to resin adhesive material within a bore hole.

30. A tensionable cable bolt as set forth in claim 29, wherein the slip prevention means comprises an anchor sleeve mounted on the cable.

31. A tensionable cable bolt as set forth in claim 30, wherein the anchor sleeve includes outwardly projecting wings for centering the cable within the bore hole and for puncturing resin adhesive cartridges.

32. A tensionable cable bolt comprising:

a length of multi-strand cable comprising a center wire and a plurality of peripheral wires spirally wrapped around the center wire;

means defining an enlarged cable section of the cable;

an outer sleeve having an inside diameter slightly less than the outside diameter of the enlarged cable section, the cable being inserted through the outer sleeve, and the enlarged cable section being pressed into one end of the outer sleeve, the outer sleeve including rotation-preventing means for preventing rotation of the outer sleeve within the mine tunnel roof borehole; and a plurality of anchor sleeves swaged onto the cable.

* * * * *